US005267644A

United States Patent [19]

Tsao

[11] Patent Number: 5,267,644

[45] Date of Patent: Dec. 7, 1993

[54] TUCKABLE CARRIER MEANS FOR HANDLING PORTABLE CONTAINER

[76] Inventor: Chung-Piao Tsao, c/o Hung Hsing Patent Service Center, P.O. Box 55-1670, Taipei (10477), Taiwan

[21] Appl. No.: 804,038

[22] Filed: Dec. 9, 1991

[51] Int. Cl.[5] ..... B65D 75/00

[52] U.S. Cl. ..... 206/151; 206/158; 206/194; 229/117.14; 294/87.2

[58] Field of Search ..... 206/145, 147, 151, 158, 206/194, 199, 427, 431, 434, 553, 562; 229/117.14; 294/87.2

[56] References Cited

U.S. PATENT DOCUMENTS

| | | | |
|---|---|---|---|
| 2,056,032 | 9/1936 | Berman | 229/155 |
| 2,333,715 | 11/1943 | Hahnemann | 206/562 |
| 2,514,858 | 7/1950 | Gray | 294/87.2 |
| 2,596,087 | 5/1952 | Shoudy | 229/155 |
| 2,661,142 | 12/1953 | Hendrickson, Jr. | 229/117.14 |
| 3,038,600 | 6/1962 | Powell | 206/158 |
| 3,156,358 | 11/1964 | Randrup | 206/194 |
| 3,897,873 | 8/1975 | Graser | 206/199 |
| 4,180,191 | 12/1979 | Wood | 294/87.2 |
| 4,244,617 | 1/1981 | Manizza | 206/199 |
| 4,273,273 | 6/1981 | Zenri | 206/145 |
| 4,372,599 | 2/1983 | Kiedaisch et al. | 294/87.2 |
| 4,405,078 | 9/1983 | Dutcher et al. | 229/117.13 |
| 4,623,185 | 11/1986 | Thomas | 206/158 |
| 4,863,094 | 9/1989 | Marrow et al. | 206/562 |

*Primary Examiner*—Allan N. Shoap
*Assistant Examiner*—Christopher McDonald

[57] ABSTRACT

A tuckable carrier includes an one-piece paper or plastic board having a pluralty of container holes formed in a central base plate portion, a pair of side-wing plate portions respectively protruding sidewardly from the central base plate portion, and a pair of handle portions respectively formed on two outer end portions of the two side-wing plate portions adapted to be held by a user's hand, in which a plurality of portable containers such as paper boxes filled with beverage liquid or foods generally formed as truncated cone shape or prismatic shape tapered downwardly can be engageably inserted into the plurality of container holes and the two handle portions formed on the one-piece board can be tucked to be held by the user's hand for carrying the portable containers conveniently.

2 Claims, 11 Drawing Sheets

TUCKABLE CARRIER MEANS FOR HANDLING PORTABLE CONTAINER

BACKGROUND OF THE INVENTION

For carrying containers such as paper box containers C for filling beverage liquid or foods in the containers, a tray T preformed with a plurality of protrusions P may be provided as shown in FIG. 15 for stably loading each container C within the several protrusions P formed on the tray T for preventing its turning over of the filled liquid or foods. This can be well done in a restaurant or coffee shop. However, when the tray T is served for a takeaway meal, the tray T loaded with plural boxes should be carried by a buyer's two hands, causing a very inconvenient handling for carrying the tray and the boxes especially when taking away from a shop to a buyer's home.

For takeaway meal service, even the liquid containing boxes can be filled in a large paper bag or case for a long distance handling, the boxes filled with liquid may be easily collapsed or falling down to cause liquid spillage or liquid contamination to the other objects.

It is therefore expected to invent a portable carrier for handling light containers such as beverage paper box container or the like which can be carried conveniently and lightly.

SUMMARY OF THE INVENTION

The object of the present invention is to provide a tuckable carrier including an one-piece paper or plastic board having a pluralty of container holes formed in a central base plate portion, a pair of side-wing plate portions respectively protruding sidewardly from the central base plate portion, and a pair of handle portions respectively formed on two outer end portions of the two side-wing plate portions adapted to be held by a user's hand, in which a plurality of portable containers such as paper boxes filled with beverage liquid or foods generally formed as truncated cone shape or prismatic shape tapered downwardly can be engageably inserted into the plurality of container holes and the two handle portions formed on the one-piece board can be tucked to be held by the user's hand for carrying the portable containers conventiently.

DETAILED DESCRIPTION

As shown in FIGS. 1–4, the present invention comprises a carrier means 1 tucked from an one-piece board 10 made of a paper board or plastic board.

Figure 1:
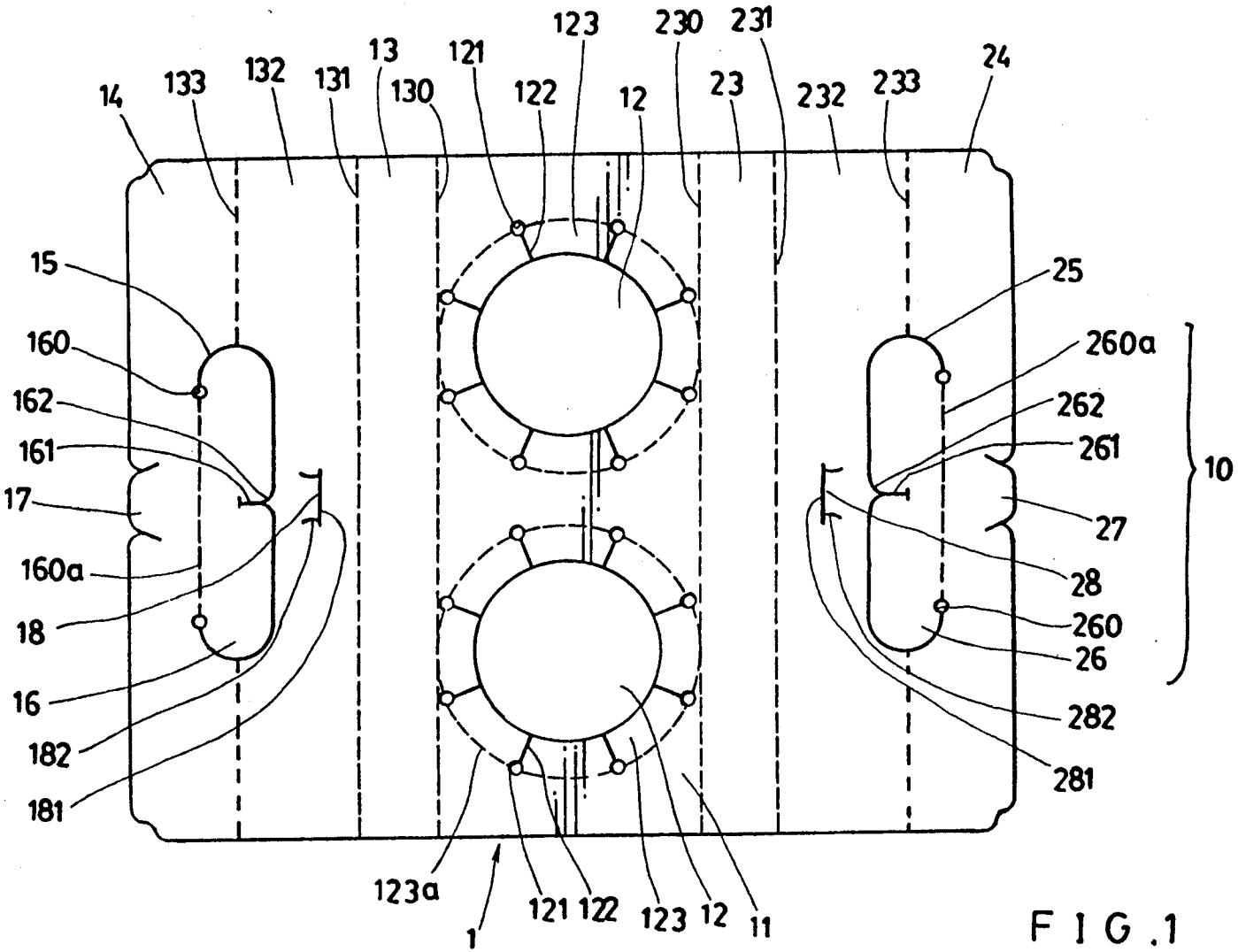
FIG. 1 is an illustration of an one-piece board for making a carrier means in accordance with the present invention.

The one-piece board 10 includes: a base plate portion 11 formed in a central portion of the one-piece board 10 having a plurality of container holes 12 such as two circular holes as shown in FIG. 1 formed in the base plate portion 11, a pair of side-wing plate portions 13, 23 respectively protruding sidewardly outwardly from the base plate portion 11, and two handle portions 14, 24 respectively formed on two outer end portions of the two side-wing plate portions 13, 23.

Each container hole 12 may be formed as circular or polygonal shape engageable with a portable container 3 or 4 filled with beverage liquid or foods in the container generally formed as truncated cone or truncated prismatic shape tapered downwardly having an upper perimeter 31 or 41 larger in size than a lower perimeter 32 or 42 of the container 3 or 4.

Figure 3:
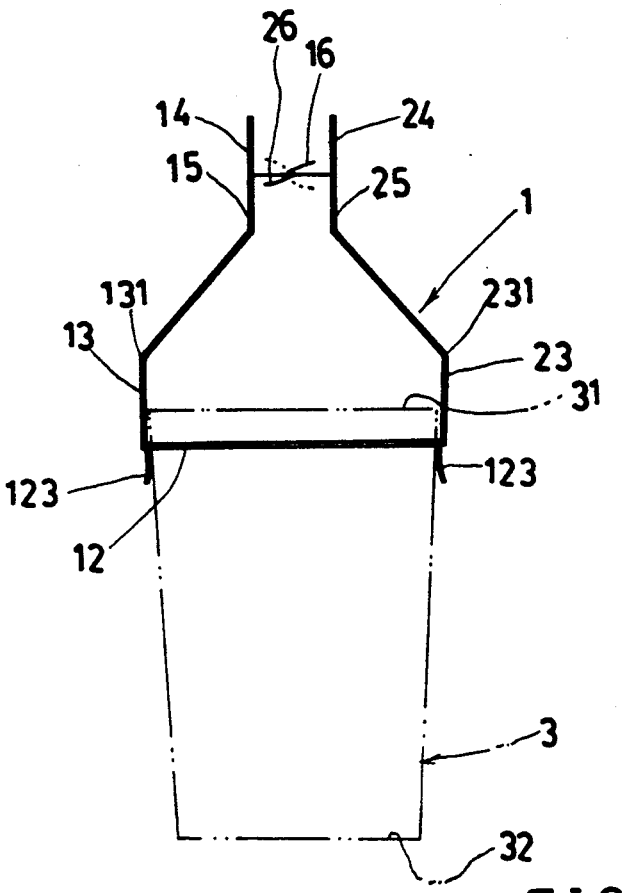
FIG. 3 is a side view of the present invention.
Figure 15:
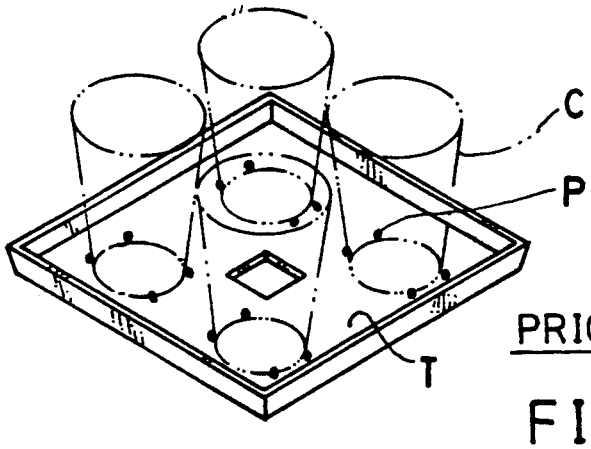
PRIOR ART FIG.15
FIG. 15 shows a prior art of a conventional tray for carrying liquid containers.

A plurality of tuckable ribs 123 are radially formed in the base plate portion 11 circumferentially disposed around each container hole 12 by radially cutting a plurality of radial slits 122 in the base plate portion 11 inwardly from the container hole 12, and a circular tuck line **123*a* is annularly formed or recessed along a periphery circularly defined by a plurality of first stress-immune perforations 121 each first perforation 121 formed at an intersected point crossed by each radial slit 122 and the circular tuck line 123*a* so that the tuckable ribs 123 are tucked downwardly to form a tucked container hole 124 as shown in FIG. 3, 4 for engageably inserting each portable container 3 formed as truncated cone shape tapered downwardly in each tucked container hole 124**.

Figure 2A:
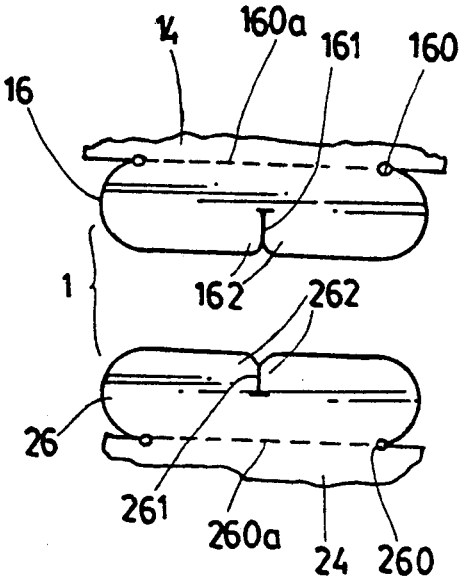
FIG. 2A shows a pair of interlockable flaps of the carrier means of the present invention.
Figure 2B:
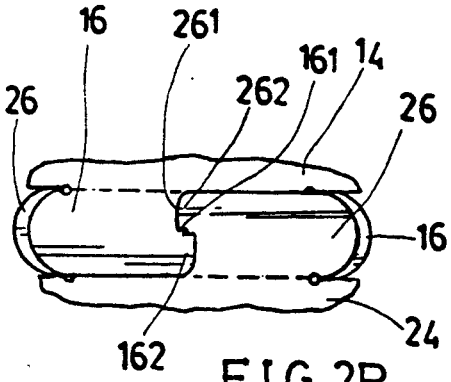
FIG. 2B shows the interlocked flaps of the present invention as shown in FIG. 2A.
Figure 2:
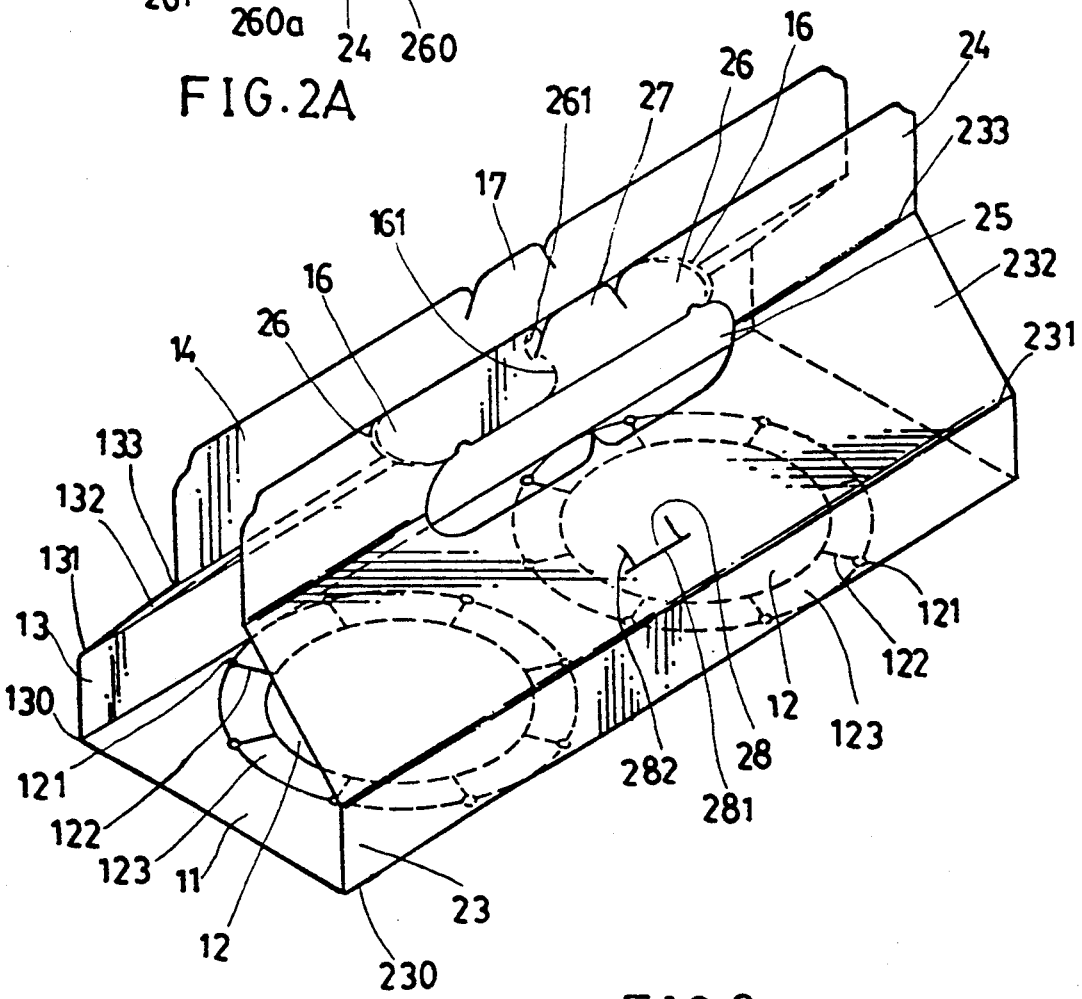
FIG. 2 is a perspective view of the carrier means of the present invention.

Each side-wing plate portion 13, 23 includes: a bottom tuck line 130, 230 formed between each side-wing plate portion and the base plate portion 11 for vertically tucking the side-wing plate portion upwardly from the base plate portion 11 as shown in FIG. 2, a convex wing tuck line 131, 231 longitudinally formed on a lower portion of the side-wing plate portion 13, 23, a concave wing tuck line 133, 233 longitudinally formed on an upper portion of each side-wing plate portion 13, 23 above the convex wing tuck line 131, 231 to define a convergent wing portion 132, 232 between the convex tuck line 131, 231 and the concave tuck line 133, 233, and the concave wing tuck line 133, 233 pertaining each handle portion 14, 24 secured to each side-wing plate portion 13, 23.

Each handle portion 14, 24 is formed with a handhole cutout 15, 25 in a lower portion of the handle portion adapted to be held by a user's hand when the two side-wing plate portions 13, 23 are tucked along the convex tuck line 131, 231 to form the two convergent wing portions 132, 232 converging inwardly with each other, and then tucked along the concave tuck line 133, 233 to vertically erect the two handle portions 14, 24 from the two convergent wing portions 132, 232.

Figure 4:
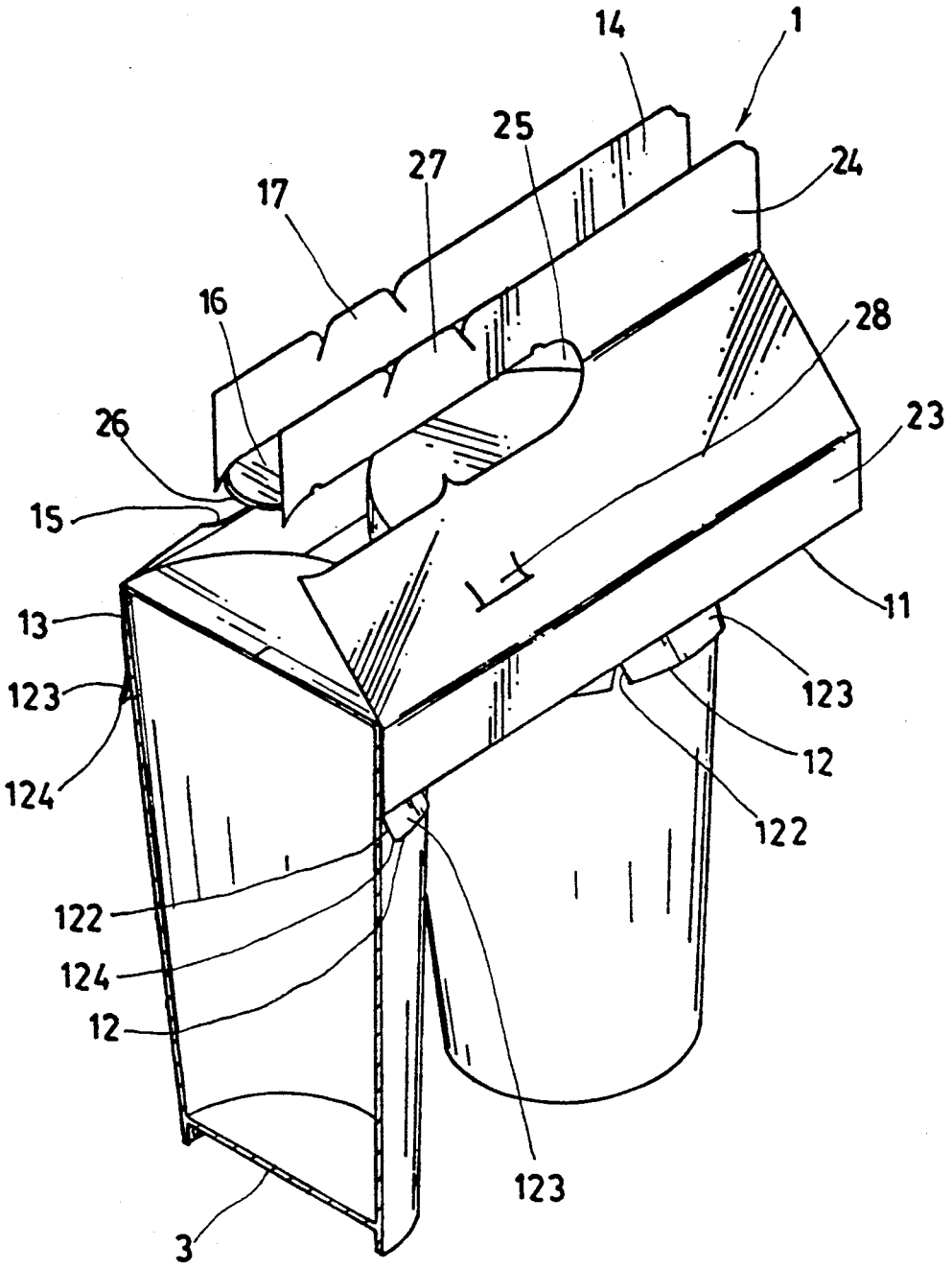
FIG. 4 is a partially cut-away illustration of the present invention.

Each handle portion 14, 24 includes an interlockable flap 16, 26 protruding inwardly from a flap tuck line **160*a*, 260*a* formed on an edge portion of the handhole cutout 15, 25 having a T-shaped slit 161 notched in a central edge portion of the flap 16, 26 to form a pair of locking tabs 162, 262 on an inner edge portion of the flap 16, 26 separated by the t-shaped slit 161, 261 so that a left locking tab 162 may be interlocked with a right locking tab 262 as shown in FIG. 2B for linking the two handle portions 14, 24 for carrying the carrier means 1 by poking a user's hand through the cutout 15, 25 as shown in FIGS. 2, 4. A second stress-immune perforation 160, 260 is formed at an intersected point crossed by the tuck line 160*a* and the flap 16, 26**.

Figure 5:
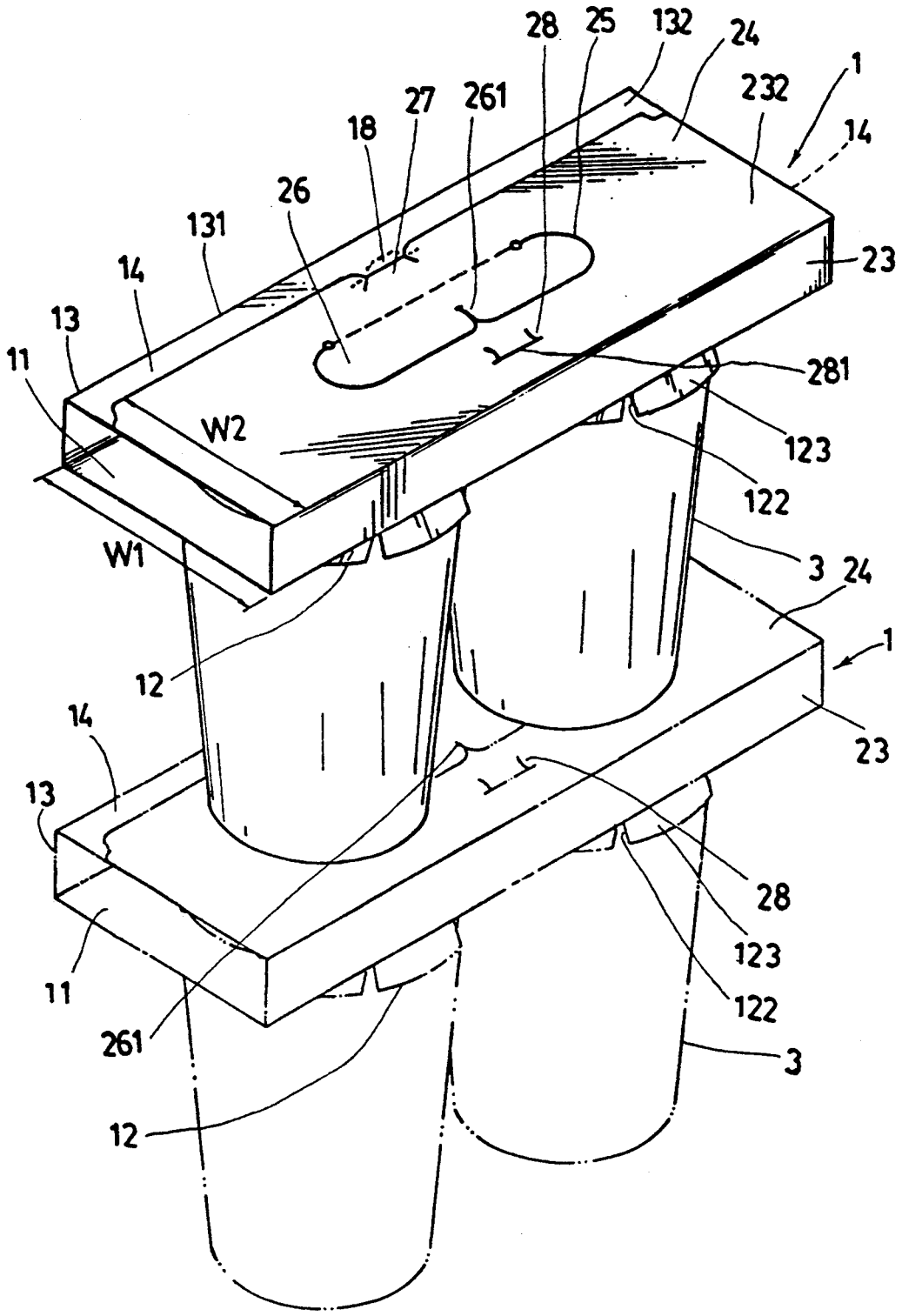
FIG. 5 shows a piling application of the present invention.

Each handle portion 14, 24 is further formed with an embedding tongue portion 17, 27 on an outer edge portion of the handle portion 14, 24, and each side-wing plate portion 13 is formed with a tongue-receiving slit 18, 28 generally Pi-shaped ($\pi$) in a convergent wing portion 132, 232 of the side-wing plate portion 13, 23 so that a right tongue portion 27 may be engageably inserted into a left tongue-receiving slit 18 for planarly embedding a right handle portion 24 on a left handle portion 14 as shown in FIG. 5 for piling a plurality of layers of the carrier means 1 and containers 3 loaded on the carrier means 1.

The slit 18, 28 includes a linear slit 181, 281 for locking the tongue portion 17, 27, and a pair of press lines 182, 282 generally perpendicular to the linear line 181, 281 adapted for an easy insertion of the tongue portion 17, 27.

Figure 6:
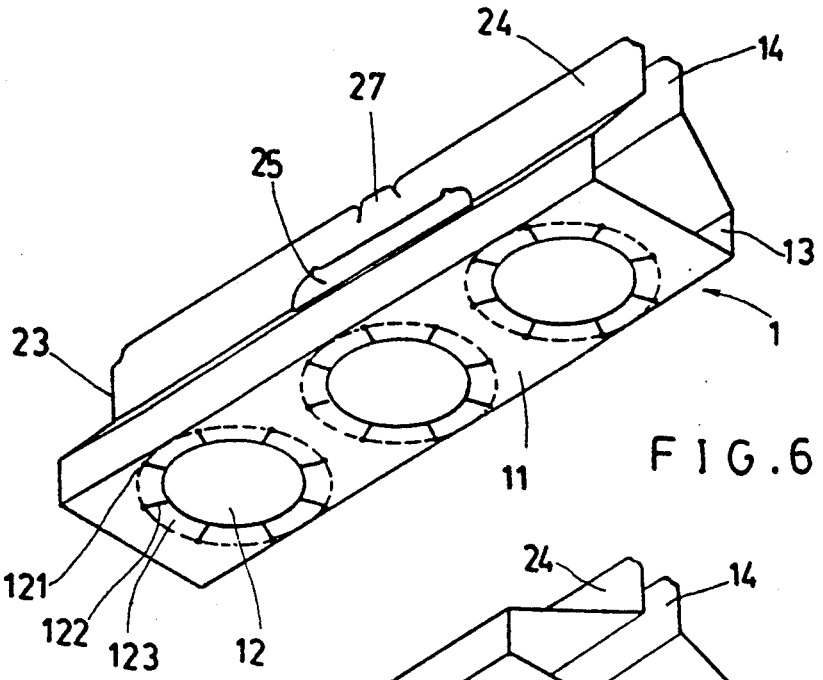
FIG. 6 shows another preferred embodiment of the present invention.
Figure 6A:
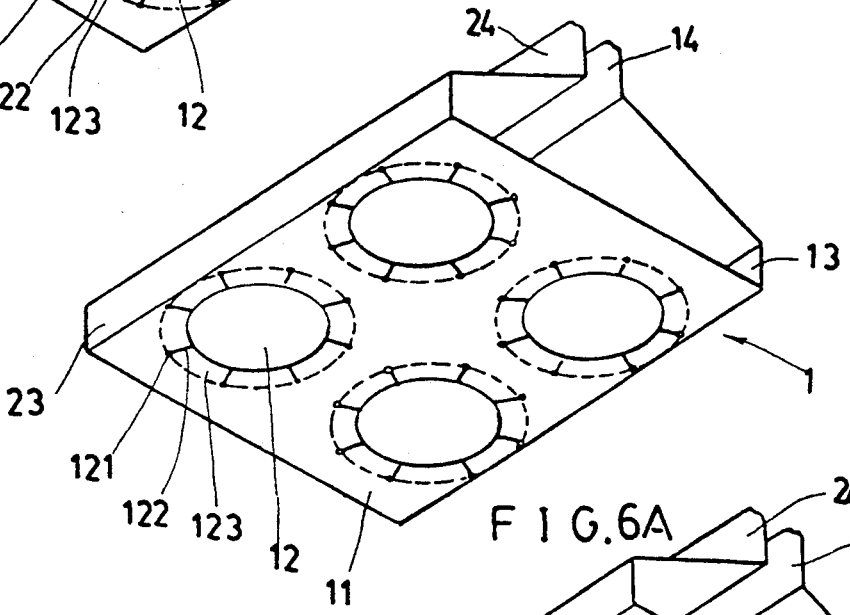
FIG. 6A shows still another preferred embodiment of the present invention.
Figure 6B:
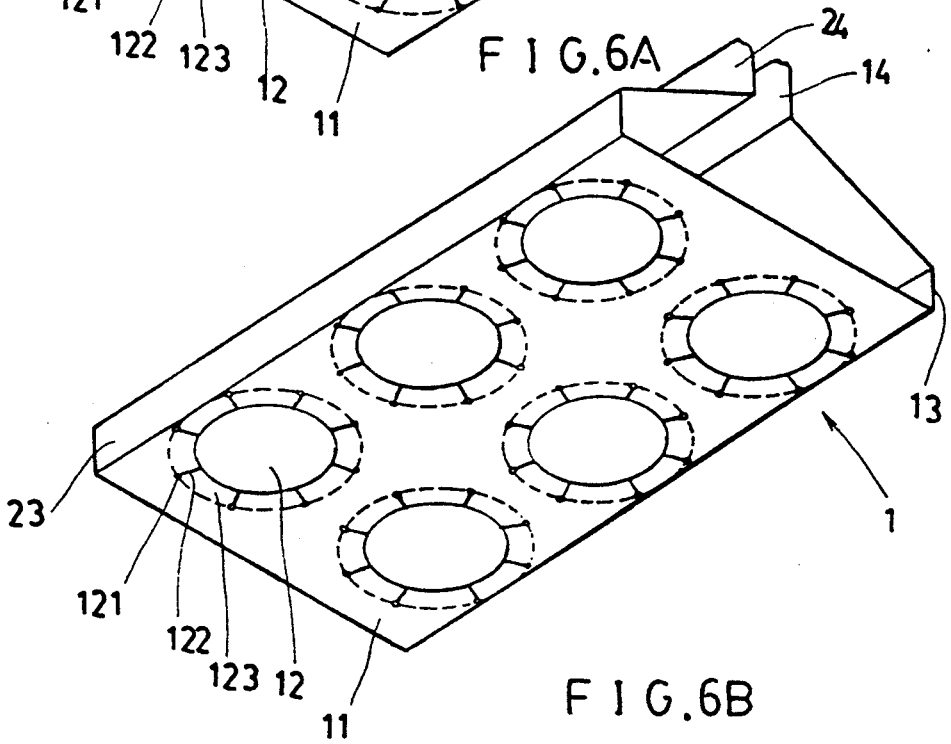
FIG. 6B shows further preferred embodiment of the present invention.

The numbers and shapes of the holes 12 of the present invention are not limited in this invention. As shown in FIG. 6, three holes 12 are formed in the carrier means 1; and there are four holes 12 and six holes 12 formed in each carrier means 1 as respectively shown in FIGS. 6A, 6B.

Figure 7:
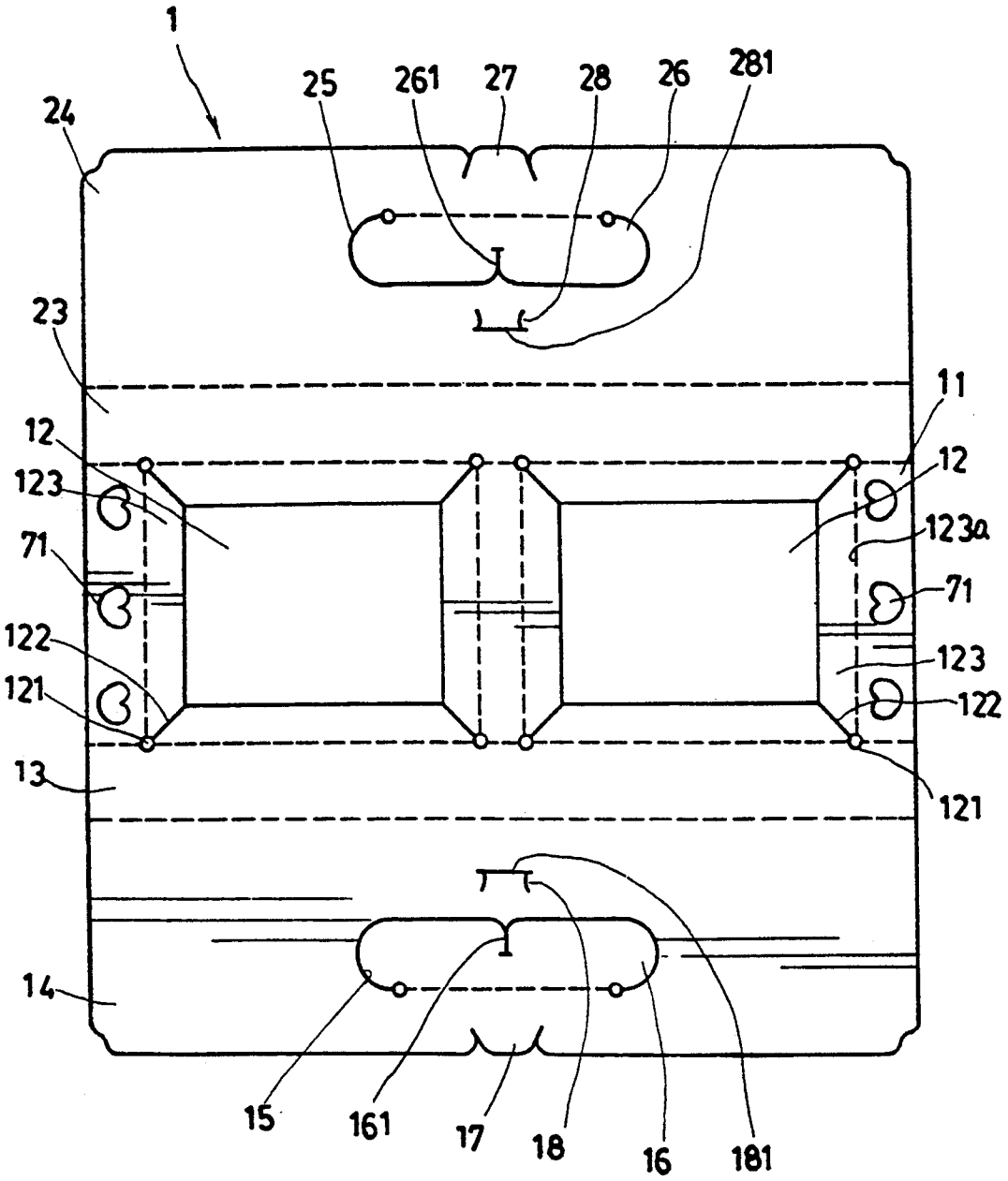
FIG. 7 is an illustration of still further embodiment of the present invention.

In FIG. 7, a plurality of tuckable ribs 123 are circumferentially formed in the base plate portion 11 around each container hole 12 by diagonally cutting a plurality of diagonal slits 122 in the base plate portion 11 inwardly from the container hole 12, and a square or polygonal tuck line **123*a* is circumferentially recessed along a contour defined by a plurality of first stress-immune perforations 121 each first perforation 121 formed at an intersected point crossed by each diagonal slit 122 and the square or polygonal tuck line 123*a* so that the tuckable ribs 123 are tucked downwardly to form a tucked container hole 124 for engageably inserting each portable container 4 formed as truncated prismatic shape tapered downwardly in each tucked container hole 124**.

Figure 8:
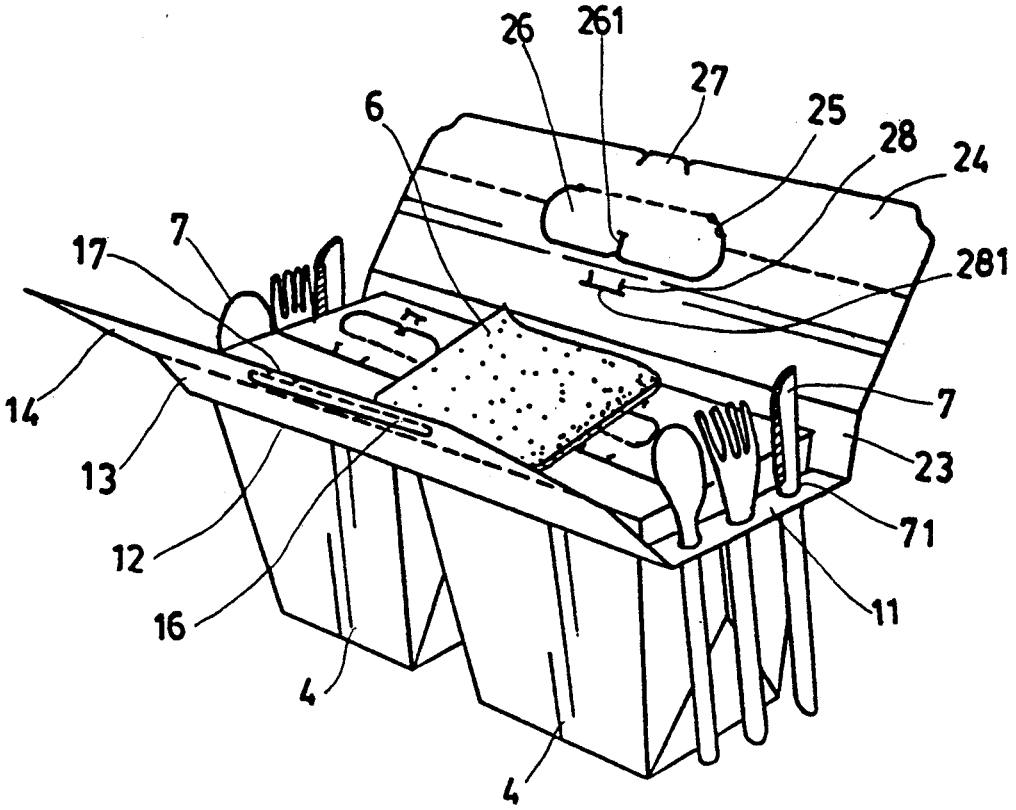
FIG. 8 shows a food-carrying application of the present invention tucked from FIG. 7.

By the way, a container with truncated tetragonal prismatic shape 4 may be engaged with the square hole 124 formed in carrier means 1 as shown in FIG. 8, 9 for filling foods in the container 4.

A plurality of eating utensil holes 71 are formed in a side edge portion of the base plate portion 11 of the carrier means 1 for holding several eating utensils 7 such as knife, spoon or fork in the utensil holes 71.

Figure 9:
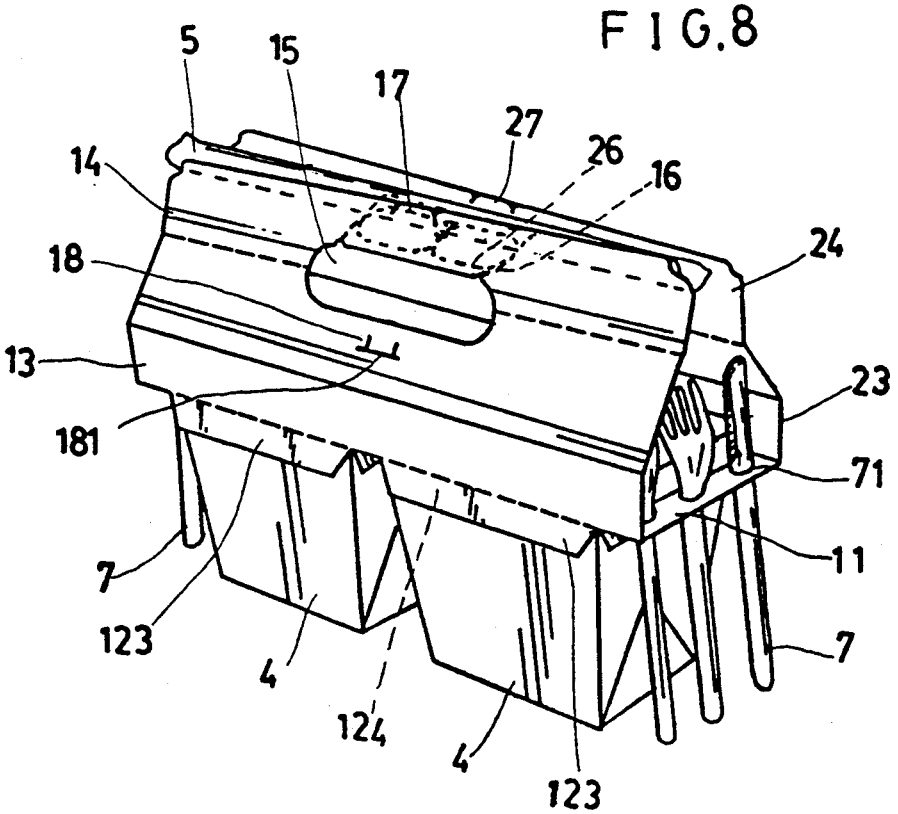
FIG. 9 shows a food-carrying application folded from FIG. 8.

A napkin 6 may be placed on an upper surface of the containers 4 and the two handle portions 14, 24 are then linked by interlocking the two flaps 16, 26 for placing chopsticks 5 on the interlocked flaps 16, 26 as shown in FIG. 9 so as for providing a carrier for handling meals for takeaway service.

Figure 10:
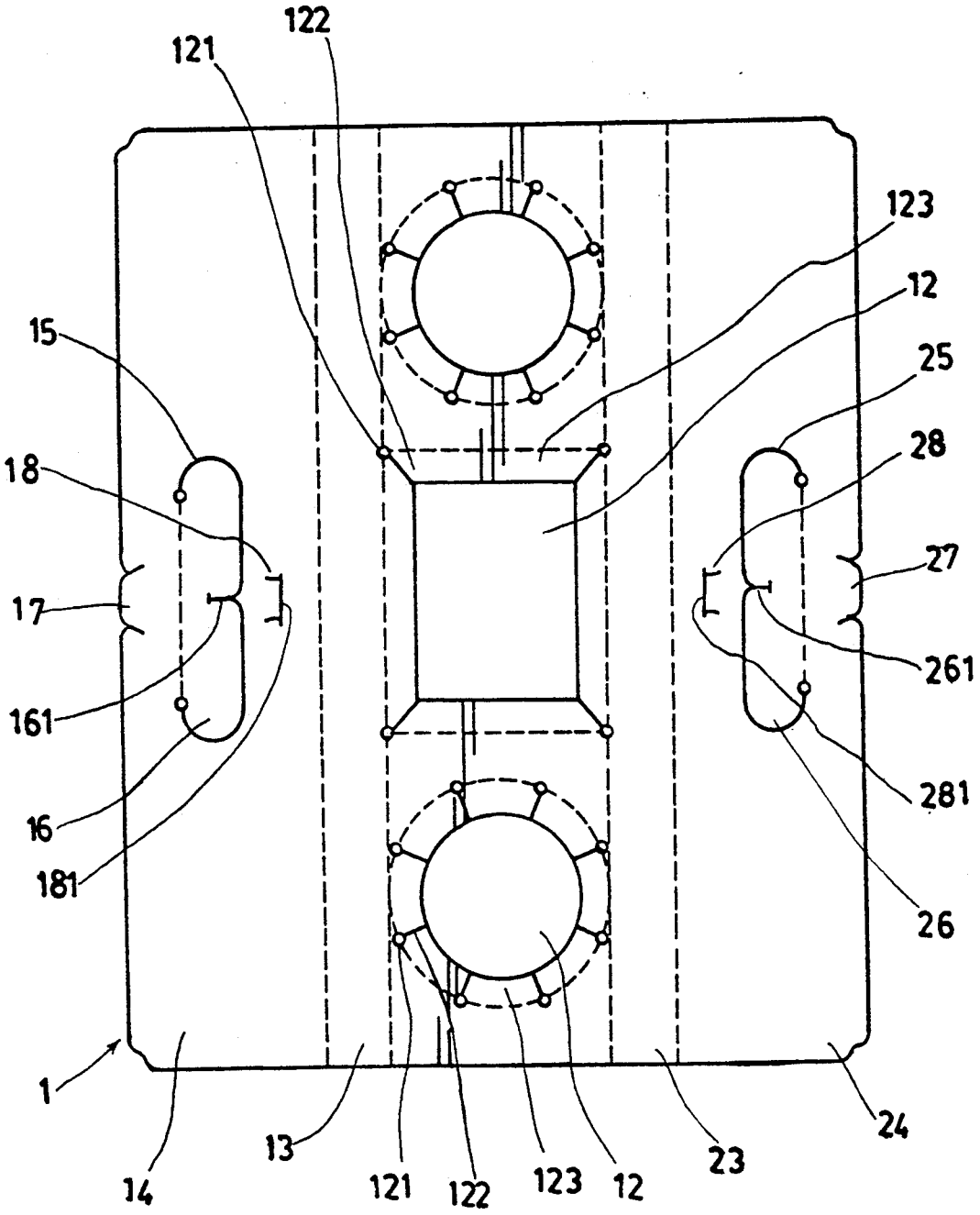
FIG. 10 shows a preferred embodiment of the present invention containing differently shaped holes.
Figure 11:
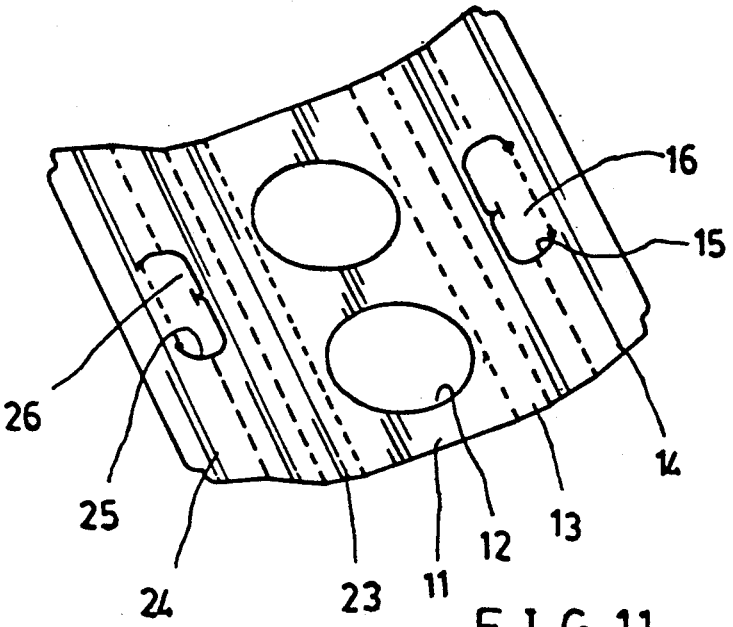
FIG. 11–14 shows the folding steps for forming a carrier in accordance with the present invention in which a tuckable rib attached to each container hole has been eliminated.
Figure 12:
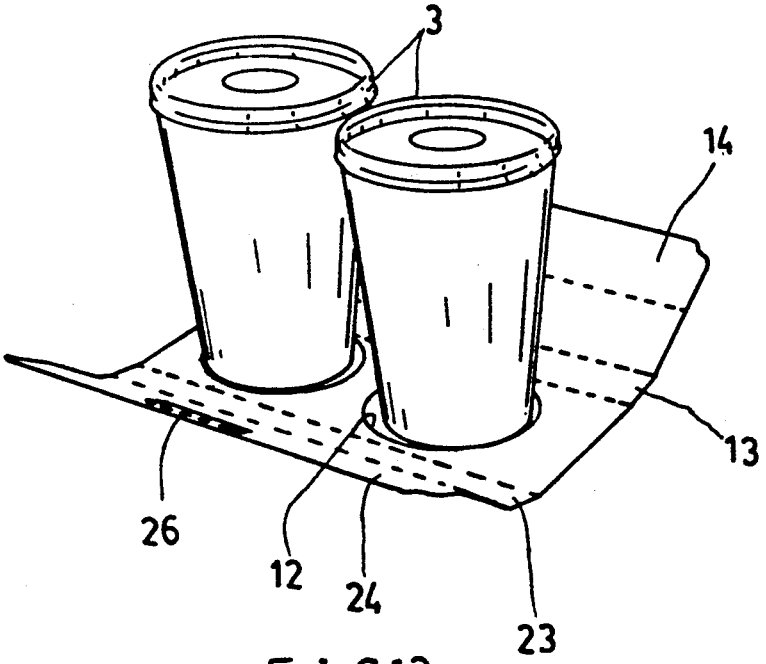
Figure 13:
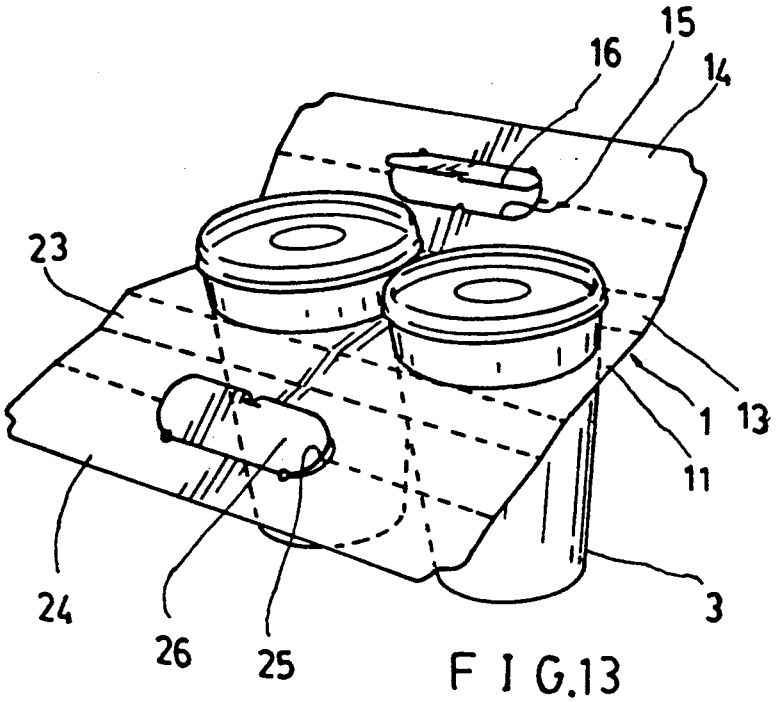
Figure 14:
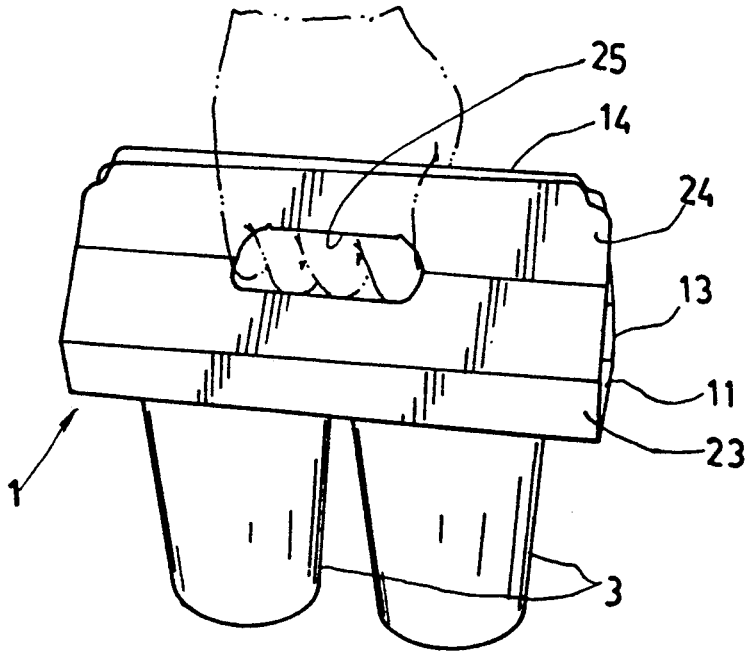

As shown in FIG. 10, several round container holes 12 and a square hole 12 are commonly formed in the carrier means 1 for diversifying its carrying purposes.

In FIGS. 11–14, each container hole 12 is simplified to be a circular hole or other shaped hole by omitting the tuckable ribs 123 disposed around the container hole 12 as aforementioned. From these figures, several steps for loading containers 3 on the carrier means 1 are shown so that a user's hand can poke through the cutouts 15, 25 formed in the handle portions 14, 24 for handling the carrier means 1 and the containers 3 held on the carrier means 1.

The present invention is superior to a conventional tray or paper or plastic bag with several advantages for a light, convenient and stable handling of liquid or foods filled in the containers without turning over or filling down for preventing spillage of liquid or foods from the container; and for greatly reducing the volume and material for forming a bag or a tray for saving cost and for solving problem of environmental pollutions.

I claim:

1. A carrier comprising:

a one piece board having a base plate portion having two opposite sides, said base plate portion having a plurality of container holes, a pair of side-wing plate portions disposed on said two opposite side portions of said base plate, said side-wing plate portions having an upper and lower portion, and a pair of handle portions attached to said pair of side-wing plate portions having an outer edge; each said side-wing plate portions including: a bottom tuck line formed between said side-wing plate portion and said base plate portion for vertically tucking said side-wing plate portion upwardly from said base plate portion, a convex wing tuck line formed on a lower portion of the side-wing plate portion, a concave wing tuck line formed between said side-wing plate portions and said handle portion and defining a convergent wing portion between the convex wing tuck line and the concave wing tuck line;

each said handle portion having a interlockable flap formed by a handhole cutout, said interlockable flaps extending inwardly toward each other and having a T-shaped slit that forms a left and right locking tab.

2. A carrier according to claim 1, wherein said handle portion is formed with an embedding tongue portion on said outer edge operatively engageable with a generally Pi-shaped slit formed in one of said convergent wing portions.

* * * * *